US007174949B1

(12) United States Patent
Hellenthal et al.

(10) Patent No.: US 7,174,949 B1
(45) Date of Patent: Feb. 13, 2007

(54) HEATABLE CALENDER ROLL

(75) Inventors: Ludwig Hellenthal, Kirchhundem (DE); Berthold Krämer, Netphen (DE); Wolfgang Krönert, Siegen (DE); Walter Patt, Siegen (DE); Joachim Schönemann, Netphen (DE); Klaus-Peter Schramm, Siegen (DE); Jaxa von Schweinichen, Netphen (DE)

(73) Assignee: Walzen Irle GmbH, Netphen (DE)

( * ) Notice: Subject to any disclaimer, the term of this patent is extended or adjusted under 35 U.S.C. 154(b) by 0 days.

(21) Appl. No.: 09/914,735

(22) PCT Filed: Mar. 1, 2000

(86) PCT No.: PCT/EP00/01731

§ 371 (c)(1),
(2), (4) Date: Feb. 11, 2002

(87) PCT Pub. No.: WO00/53847

PCT Pub. Date: Sep. 14, 2000

(30) Foreign Application Priority Data

Mar. 5, 1999 (DE) ..... 199 09 647

(51) Int. Cl.
*F28F 5/02* (2006.01)
*F28F 13/00* (2006.01)

(52) U.S. Cl. ..... 165/90; 165/96; 165/135

(58) Field of Classification Search ..... 165/86, 165/89, 90, 96, 135
See application file for complete search history.

(56) References Cited

U.S. PATENT DOCUMENTS 5,285,844 A * 2/1994 Schneid ..... 165/89
5,404,936 A 4/1995 Niskanen et al.
6,460,611 B2 * 10/2002 Zaoralek ..... 165/89

FOREIGN PATENT DOCUMENTS

EP 0285081 10/1988

* cited by examiner

*Primary Examiner*—Allen Flanigan
(74) *Attorney, Agent, or Firm*—Friedrich Kueffner

(57) ABSTRACT

The invention relates to a calender bowl which can be heated by means of a heating medium that is in a liquid or gaseous state of matter. The calender bowl comprises a roll body (1) that is provided with peripheral bores (4) and flange journals (2, 3) comprising supply and discharge conduits for the heating medium. Thermal insulating bushes (8) are mounted on the end areas of the peripheral bores. The heating medium flows through the peripheral bores. The aim of the invention is to adapt the heat transfer from said bores to the lateral surface of the roll body to the respective heat requirements in such a way that the harmful measured differences stay within limits so that the product is not impaired. To this end, adjusting devices are allocated to the flange journals for controllably turning and/or axially displacing the insulating bushes.

6 Claims, 1 Drawing Sheet

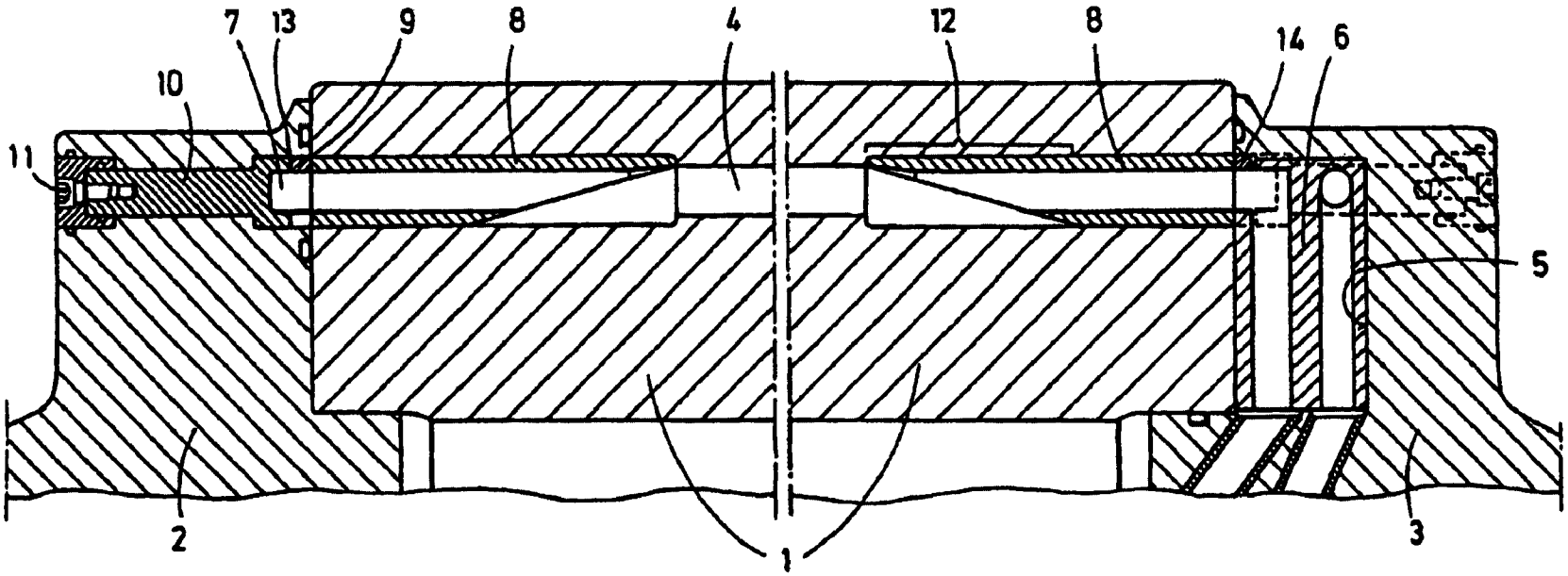
Figure

HEATABLE CALENDER ROLL

BACKGROUND OF THE INVENTION

1. Field of the Invention

The invention relates to a calender roll heated by means of a heating medium in a liquid and/or gaseous state of matter, comprising a roll body provided with peripheral bores and is provided on both ends with flange journals provided with supply and discharge lines for the heating medium, and wherein the respective end areas of the peripheral bores are provided with thermal insulation bushings. Such calender rolls are commonly used, for example, for paper manufacture. The further development of the processes in the web manufacture, however, requires increasingly a more exact cylindricity of the heatable calender rolls as a result of changed temperatures and different web widths. In this connection, in particular thermally caused dimensional differences of a few μm can be the deciding factor in regard to the quality or even rejection of the product to be manufactured.

2. Description of the Related Art

It has been attempted to compensate shape errors of the heatable calender rolls, which result from the mechanical bending and from areas of different temperatures, by means of bending compensation rolls (multizone rolls). However, this has only been successful as long as the shape errors have a relatively long wave length and the correction potential of the bending compensation roll is sufficient. On the other hand, in the case of heatable calender rolls it has been attempted to control the heat introduction into the roll bodies with different thermal insulations. Also, the targeted temperature adjustment or insulation of the journal flanges for compensation of errors is known. Frequently, the opening areas of the peripheral bores are provided with fixedly mounted thermal insulation bushings in order to reduce the heat transfer into the end areas of the roll bodies and thus across the areas which are used by the web width.

SUMMARY OF THE INVENTION

The invention has the object to adjust the heat transfer from the peripheral bores, through which the heating medium flows, to the mantle surface of the roll body to the respective heat demand such that the detrimental dimensional differences are maintained within limits that do not negatively affect the product.

This object is solved with the features of claim 1. They allow a variable thermal edge isolation of the roll body and thus influencing of the thermal profile of the roll body in its edge area, by which its adjustment to the different heat removals in the web width end areas as well as the web width that is being processed can be taken into account, wherein a simple, effective, and central adjustment possibility is provided.

Advantageous, expedient, and inventive further developments of the subject matter of the claims can be taken from the dependent claims.

In detail, the features of the invention are explained by means of the description of an embodiment in connection with a drawing illustrating it.

BRIEF DESCRIPTION OF THE DRAWING

The single FIGURE of the drawing is a sectional view of a roll body of a heatable calender roll according to the present invention.

DETAILED DESCRIPTION OF THE INVENTION

In the drawing two details of the roll body 1 of the heatable calender bowl are represented in section and discontinuous which are adjoined by two flange journals 2, 3 shown in vertical section and also discontinuous. In the area of the outer mantle, peripherally arranged bores 4 are provided which are supplied by a supply line arranged in the flange journal 3 with a liquid and/or gaseous heating medium. The flange journal 3 for this purpose is provided with radially extending grooves 5 which are provided respectively with an insert body 6 which has a first guide path to the opening of one of the bores 4 which contain a second guide path which is bent laterally at the top or is branched and is thus in communication with the neighboring openings of the bores 4. In the flange journal 2 a circumferential groove 7 is provided which connects all openings of the peripheral bores 4 on the left side with one another.

For reducing the heat transfer in the area of the ends of the web width of the paper webs to be placed about the roll body, the end areas of the peripheral bores 4 are provided with thermal insulation bushings 8 which for reducing the heat transfer are, for example, manufactured as a unitary part of plastic material; however, they can also be produced of metal with a plastic coating or can be comprised of several layers wherein at least one of the intermediate layers is thermally insulating. The inwardly oriented area 12 of the insulation bushing 8 is embodied at a slant in the embodiment so that the upper side in this illustration is supported on a flange provided in the bore 4 while the opposite side is embodied to be substantially shorter. The thermal insulation bushings 8 insulate therefore in the one direction substantially stronger than in the other direction; and since they are not fixedly mounted, for example, by upending, but are instead secured so as to be easily rotatable, it is possible by rotation of the insulation bushings 8 to control or adjust the heat transfer in the end area of the bores 4. In the illustrated position a reduction of the heat flow results toward the mantle of the roll body 1 which could be eliminated if the insulation bushings 8 were rotated relative to the illustrated position by 180°. Then the heat transfer to the outer mantle would not be disrupted by insulating layers and would thus be intensified.

For adjusting the position of the insulation bushings, their outer end faces are provided with a gear ring having outwardly projecting teeth. A gear ring 9 is inserted into the groove 7 which is guided on the outer flank of the groove and has such a large diameter that its teeth mesh with outwardly projecting teeth of the insulation bushings 8, respectively. This gear ring 9 has also a corresponding toothing at the side facing away from the insulation bushings 9 which meshes with a toothing 13 of an adjusting bolt 10. This adjusting bolt is connected by a screw with an adjusting head 11 which can be adjusted by means of a tool.

In this way, there is the possibility to actuate by means of a tool the adjusting head 11 which adjusts with its toothing 13 the gear ring 9 which, in turn, engages the spur wheel toothings of all insulation bushings 8 opening at the same side and adjusts them by the desired amount so that the heat transfer in the desired amount is determined.

The same type of arrangement is provided at the opposite side. Here also a gear ring 14 is rotated by an adjusting head 11 and rotates, in turn, the insulation bushings 8 which engage with its spur wheel toothing the gear ring 14.

The arrangement can be modified in a large number of ways. For example, the adjusting head can be formed as guide body fixed to the flange journal and the adjusting process can be realized by a positive-locking actuation of the corresponding screw. Also, it is not required to provide the adjusting bolts 10 only once on each flange journal 2 or 3; and it is also not required to arrange them axis-parallel: Radially positioned adjusting bolts do not require gear rings but only simple spur wheels so that the cross-section of the circumferential groove 7 is not negatively affected. Also, the shape of the insulation bushings can be changed within a wide range, wherein apparently the simplest form is the one illustrated in which the insulation bushing ends at a slanted surface; however, it would also be possible, for example, to divide the end of the bushing by an axial cut and to remove one of the thus formed semi-tubes. Finally, the entire adjusting device can be embodied such that the insulation bushings 8 are axially moved within the opening areas of the peripheral bores. In any case, in the boundary area of the width of the placed webs to be processed the heat supply to the mantle is intensified or reduced by means of heat paths of different width traveled within the metal of the roll body so that the desired adjustment is possible.

The invention claimed is:

1. A calender roll heatable by means of a heating medium in a liquid and/or gaseous state of matter, the calender roll comprising a roll body having a plurality of peripheral bores, wherein the roll body is provided at both ends thereof with flange journals having supply and discharge lines for the heating medium, and wherein end areas of the peripheral bores are provided with thermal insulation bushings, and adjusting devices correlated with the flange journals for a determinable rotation of the insulation bushings.

2. The calender roll according to claim 1 wherein the insulation bushings extend in areas of inner ends thereof only over a portion of a circle.

3. The calender roll according to claim 1 wherein, in an area correlated with an inner end of each insulation bushing, the insulation bushing extends only across a predetermined central angle.

4. The calender roll according to claim 3 wherein the central angle decreases toward the inner end.

5. The calender roll according to claim 1 wherein each insulation bushing is provided with a toothing on an outer end face of the insulation bushing, wherein the toothing on the outer end face meshes with a toothing of a gearing arranged in a circumferential groove of a facing flange journal.

6. The calender roll according to claim 5 wherein each flange journal comprises at least one adjusting bolt having a gear ring or a gear wheel at an end of the adjusting bolt facing the roll body or oriented toward its axis.

* * * * *